United States Patent [19]

Gaia

[11] Patent Number: 4,524,344

[45] Date of Patent: Jun. 18, 1985

[54] ELECTRIC FUSE

[75] Inventor: Aldino J. Gaia, St. Louis, Mo.

[73] Assignee: McGraw-Edison Company, Rolling Meadows, Ill.

[21] Appl. No.: 541,239

[22] Filed: Oct. 12, 1983

[51] Int. Cl.[3] ..... H01H 85/04

[52] U.S. Cl. ..... 337/159; 337/290; 337/295

[58] Field of Search ..... 337/159, 158, 290, 295

[56] References Cited

FOREIGN PATENT DOCUMENTS 1300136 12/1972 United Kingdom ..... 337/295

*Primary Examiner*—Harold Broome

*Attorney, Agent, or Firm*—John S. Paniaguas; Charles W. MacKinnon; Jon Carl Gealow

[57] ABSTRACT

An electric fuse includes a tube of insulating material with first and second open ends. Metallic or electrically conducting end caps are placed on each of the first and second ends. A fuse element is mounted with the tube in electrical contact with the end caps. The fuse element includes an elongated body defined by a plurality of heavy portions and a plurality of weak spots. Each weak spot is located between adjacent heavy portions. The weak spots are linear fusible portions integrally connected to adjacent heavy portions and are transverse to an axis extending along the length of the element. Each heavy portion includes first and second ends. A first adjacent heavy portion is connected at a first end of a weak spot and a second adjacent heavy portion is connected to a second end of the weak spot, such that the first ends of adjacent heavy portions are transversely offset from each other.

16 Claims, 4 Drawing Figures

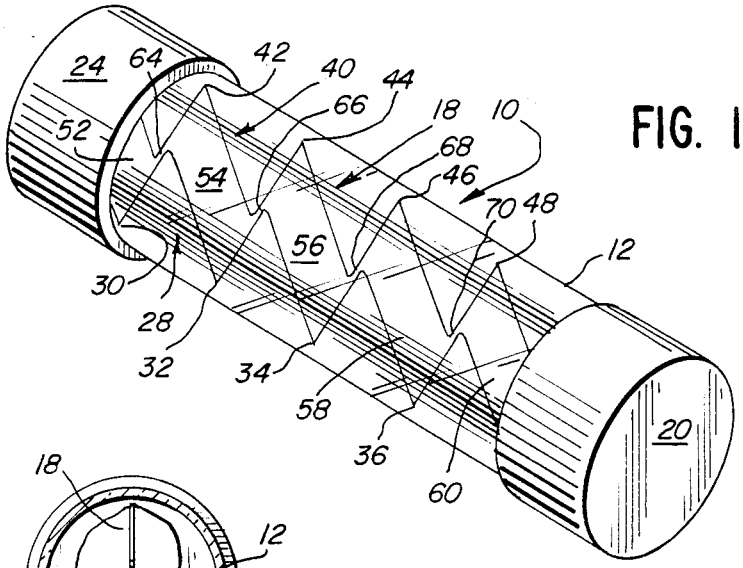
FIG. 1
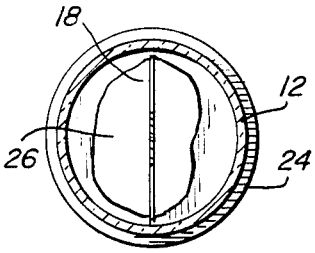
FIG. 4
FIG. 2
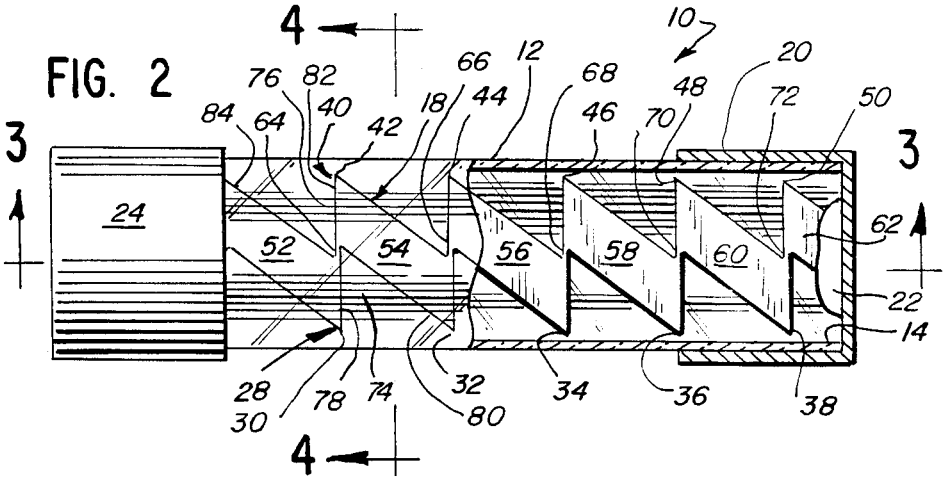
FIG. 3
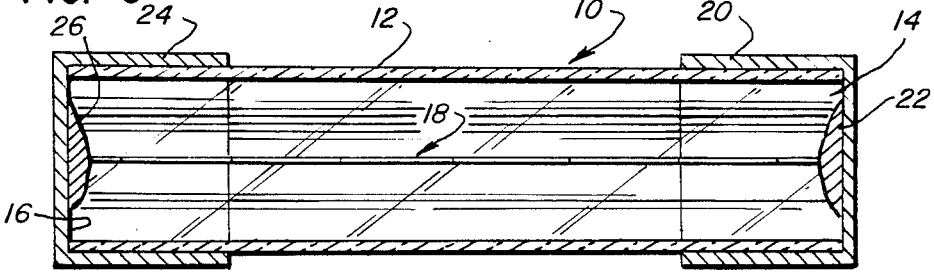

ELECTRIC FUSE

BACKGROUND OF THE INVENTION

The present invention relates to a new and improved electrical fuse and more particularly, to a new and improved electrical fuse including a fuse element with weak spots and heavy portions. The weak spots form necks between the heavy portions and are transvese to the length of the fuse element and parallel to each other.

If resistance in an electrical circuit is abnormally low, usually due to an accidental cause, current flow will increase considerably. If the resistance approaches zero because of a short or heavy overload within the protected circuit, the current in the circuit can range from tens to hundreds of times greater than the normal current. Substantial harm can be expected to occur quickly under these conditions in the form of thermal, magnetic and arcing damage. Therefore, time is critical in removal of supply power to shorted or heavily oveloaded circuits. Damage as a result of these conditions is generally prevented by the inclusion of fuses in the supply line of the circuit to be protected. The simplest fuse is a length of thin wire which in the event of a short circuit is heated rapidly by the high current and melts away thus interrupting the circuit.

Current limiting single element fuses provide safe and reliable protection for most electrical circuits. Such fuses operate when increased fuse element temperature caused by an overcurrent flowing through them melts the element. Since the functioning of these fuses does not depend on the operation of intricate moving mechanical parts, performance characteristics are generally quite consistent and reliable. A single element fuse usually consists of one element within an insulative tube having electrically conductive end caps. Each element is defined by a plurality of heavy portions separated by weak portions also called fusible portions or weak spots. If the electrical circuit in which a fuse is included as protection experiences a short circuit or heavy overload, high current flow quickly begins melting the weak spots. As this occurs, arcing across the melting or vaporizing weak spots commences. Once the arcs are extinguished, the circuit is cleared and the potentially damaging current flow ceases. Therefore, fast arc extinguishing speeds are desirable to protect the system components from damage due to heavy overload and short circuits.

An important feature of most single and parallel element fuses is their ability to quickly extinguish arcs between the portions of larger cross sectional area after the weak spots have melted or vaporized. Another important feature of such fuses is their ability to prevent the system open circuit voltage from restriking arcs across the open weak spots of the fuse element after the arcs have been initially extinguished. A typical fuse element includes weak spots or fusible portions which extend in a direction generally parallel with the length of the element. Arcing then occurs generally in a direction parallel to the long axis of the fuse element between its heavier portions, thereby allowing greater burn back into the heavy portions and increasing the time needed to clear the circuit. This also increases the potential for the arcs to communicate with each other.

A further important feature in fuses of this type is the ability to keep the weak spots well away from the side walls of the insulative container tube, particularly during periods of overload and clearing. It is often the case, during periods of even small overloads, that fuse elements may bow along their length due to thermal expansion. If the fuse element is not properly designed or is improperly manufactured, the weak spots near the center of the fuse element may closely aproach or touch the inside wall of the insulative container tube. This is mosr likely to occur during periods of overload which may cause substantial thermal expansion and bowing of the fuse element. As the weak spots approach or touch the walls of the container tube, heat which would have contributed to weak spot melting is drawn away by the tube walls, thereby cooling the weak spots and possibly causing substantial changes in the clearing characteristics of the fuse. Such a fuse might carry a higher than rated current for a much longer period of time before clearing than would normally be expected. In addition, as clearing begins, the products of the melted or vaporized weak spots may be deposited on the inside wall of the container tube adjacent the weak spot. Arcing may be prolonged through these deposits if they are in close enough proximity to the arc.

Therefore, it is very important that the weak spots of the element be kept well away from the inside walls of the insulative tube at all times. However, many fuse elements are designed such that their weak spots may approach or touch the walls of the container tubes, particularly during an overload because of thermal expansion and bowing. Many fuses may even be assembled such that the element and weak spots approach or touch the container tube after manufacture and before any current flows through them.

An additional important feature in fuses of this type is that they must include sufficient structural integrity to avoid bending along their width or along their length through their weak spots, particularly during manufacture and high current cycling. During manufacture, the fuse elements are subjected to numerous forces from their original blanking through assembly stages to final end can attachment and soldering. Inadvertent bends at weeak spots may either break the element or cause changes in its clearing characteristics. During high current cycling, the fuse element expands and contracts as current flow increases and decreases, causing flexing and bowing of the element. An improperly designed element can place an unusually large amount of stress on already softened weak spots during high current cycling, causing metal fatigue at the weak spots and possibly premature fuse failure.

Some examples of possible fuse element arrangements are illustrated in British Patent 1,300,136. The heavy portions or portions of larger cross sectional area are aligned on both sides of the weak spots such that beinding along an axis formed through the weak spots can readily occur. Such bending could place the weak spots in contact with or in close proximity to the inside insulative tube wall. Further, high current cycling may cause tortional stresses and fatigue at the weak spots of at least some of the disclosed elements. The disclosed elements are also very susceptible to inadvertent bending during manufacture.

A second example of possible fuse element arrangements is illustrated in U.S. Pat. No. 2,682,587, wherein at least one embodiment of an element is disclosed which includes a weak spot having a current path transverse to the long axis of the element. However, only a single weak spot is shown resulting in poor clearing of the circuit because the opened circuit voltage across a single weak spot is often great enough to permit restrike of the arc during clearing. Restrikes of the arc allow potentially damaging additional overcurrents into the protected circuit and therefore, are very undesirable.

Additional examples of typical fuse elements are illustrated in U.S. Pat. Nos. 1,788,623; 2,507,747; and 3,417,357 and German Pat. No. 1,005,669. The current paths through the weak spots connecting heavy portions of the fuse elements are generally parallel to the long axis of the elements. In those cases where the current paths are not directly parallel to the length of the fuse, the path is offset by an angle which would not substantially diminish the arc burn back into the heavier portions of the element. Therefore, these fuse elements provide little or no advantage over elements having weak spot current paths parallel to the long axis of the element.

SUMMARY OF THE INVENTION

An object of the present invention is to provide a new and improved fuse.

A second object of the present invention is to provide a new and improved fuse that quickly clears and minimizes arcing and restrikes across melted weak spots of the fuse element.

A further object of the present invention is to provide a new and improved fuse element with parallel weak spots which extend transverse to the length of the fuse element and which is constructed with structural integrity to avoid excessive bending and fatigue at the weak spots.

A still further object of the present invention is to provide a new and improved fuse including a fuse tube and fuse element with weak spots wherein the fuse element is constructed to keep the weak spots well away from the inside wall surfaces of the fuse tube at all times.

Briefly, the present invention is directed to a new and improved fuse that includes a tube of insulating material with first and second open ends. First and second metallic or electrically conductive end caps are positioned on the first and second open ends of the tube. A fuse element is mounted within the tube and makes electrical contact with the first and second end caps. The fuse element is defined by a plurality of heavy portions having larger cross sectional areas and a plurality of integral weak spots located between adjacent heavy portions. The weak spots are in parallel to each other and transverse to the length of the fuse element. Adjacent heavy portions are offset relative to each other decreasing the likelihood and extent of arcing in a short circuit or heavy overload situation.

The above and other objects and advantages and novel features of the present invention will become apparent from the following detailed description of a preferred embodiment of the invention illustrated in the accompanying drawings.

BRIEF DESCRIPTION OF THE DRAWINGS

FIG. 1 is a perspective view of a fuse constructed in accordance with the principles of the present invention;

FIG. 2 is a partially cut away, side view of the fuse illustrated in FIG. 1; and FIG. 3 is a cross-sectional view taken along line 3—3 of FIG. 2;

FIG. 4 is a cross-sectional view taken along line 4—4 FIG. 2.

DETAILED DESCRIPTION OF THE PREFERRED EMBODIMENT

Referring to the drawings, there is illustrated a current limiting single element fuse generally designated by the reference numeral 10. Fuse 10 is used to protect electric circuits from abnormal conditions, such as a short circuit and heavy overloads.

Fuse 10 is defined by a tube 12 of insulating material, such as glass, open at a first end 14 and a second end 16 (FIG. 3). A fuse element generally designated by the reference numeral 18 is positioned within tube 12. Fuse 10 is closed by a first metallic end cap 20 secured over first end 14 of tube 12. Cap 20 is electrically and mechanically connected to the fuse element 18 by electrically conductive material 22 such as solder. A second end cap 24 is mounted on second end 16 of tube 12 and electrically and mechanically secured to element 18 by electrically conductive material 26 similar to material 22.

Element 18 includes a first side 28 of a saw tooth configuration with tips 30, 32, 34, 36 and 38. A second side 40 is also of a saw tooth configuration with tips 42, 44, 46, 48 and 50. Tips 30–38 and 42–50 of element 18 may engage the interior peripheral surface of tube 12 during assembly of fuse 10 and assist in centering element 18 within tube 12. As element 18 heats and expands during an overcurrent condition, tips 30–38 and 42–50 may engage the inner peripheral surface of tube 12 and thereby dissipating some heat. However, since tips 30–38 and 42–50 are essentially points, there is very little heat dissipation and it takes place at points well away from the weak spots . This may be compared to prior art fuses with weak spots that may engage the tube during expansion resulting in substantially greater dissipation of heat. Substantial heat dissipation permits more damaging energy to enter the protected circuit before the fuse clears.

Fuse element 18 is elongated with a longitudinal axis extending the length of element 18 between the ends secured by material 22 and 26. Element 18 includes a plurality of heavy portions 52, 54, 56, 58, 60 and 62. Heavy portions 52–62 are joined end to end by weak spots 64, 66, 68, 70 and 72.

Weak spots 64–72 are narrow necks generally known as linear fusible portions and are positioned between adjacent heavy portions. Weak spots 64–72 are geometrically parallel and extend transversely to the longitudinal axis of fuse element 18 as opposed to the longitudinal orientation typically found in prior art fuses. Electrically weak spots 64–72 are in series.

The transversely extending and parallel weak spots cause arcs occurring during clearing of the circuit to be parallel and transverse to the length of the fuse, thereby avoiding communication with each other. Arcing in the typical fuse vaporizes the weak spots and extends into the heavy portions. This arcing must be extinguished to clear the circuit. Due to the parallel and substantially transverse orientation of weak spots 64–72, there is less burn back into heavy portions 52–62, thereby providing for rapid arc extinguishment, and quicker clearing of the circuit. Less material is volatized in heavy portions 62–60 during clearing reducing the amount of energy required before fuse 10 interrupts the circuit.

Although arcs across weak spots 64–72 are in series, they are not in alignment but extend transversely to the longitudinal axis of fuse element 18. Consequently, each entire heavy portion 52–62 must be burnt nearly completely away in order for the arcs to bridge from one weak spot to another. This would require a power source which could supply an extremely large amount of energy.

The parallel and transverse orientation of weak spots 64–72 also allows for a larger number of weak spots. This larger number of weak spots 64–72 is desirable, since although the current through each weak spot is equal, the voltage across fuse element 18 is divided over the number of weak spots 64–72. Therefore, the voltage across each weak spot 64–72 is much lower and the arcs across them dissipate more quickly thereby driving the current to zero more quickly.

The distance between the ends 14 and 16 is a limiting factor in the number of weak spots and heavy portions in a given fuse. Since weak spots 64–72 are transverse to the longitudinal axis of element 18, it is possible to provide more weak spots in the same length of fuse element 18 thereby decreasing the voltage across each one.

Considering specifically the fusible portions and for illustrative purposes weak spot 64, weak spot 64 is situated between notch 74 defined in side 28 of element 18 and notch 76 defined in side 40. Notch 74 includes a side edge 78 which extends substantially transversely to the longitudinal axis of element 18. Notch 74 also includes an upper edge 80 extending at an acute angle to edge 78. Similarly, notch 76 includes a side edge 82 extending substantially parallel to edge 78 and substantially transversely to the longitudinal axis of element 18. Notch 76 also includes a lower or second edge 84 substantially parallel to edge 80 and at an acute angle to edge 82. Weak spot or fusible portion 64 is defined between edges 78 and 82 and the point of meeting of edges 78 and 80 and edges 82 and 84. Each weak spot 66–72 is defined between similar edges of notches in element 18. Weak spots 64–72 are narrow in their transverse dimension and are relatively short in length. However, they are of sufficient length, such that heavy portion 52 is offset relative to adjacent heavy portion 54. Consequently, adjacent heavy portions 52–62 are offset on opposite sides of the weak spots 64–72 making communication or bridging between the arcs more difficult, further decreasing the time to clear the circuit.

While a particular embodiment of the invention have been shown and described, it should be understood that the invention is not limited thereto as modifications may be made particularly in the element housing and dimension ratios. It is therefore contemplated to cover by the present application, any and all such modifications as fall within the true spirit and scope of the appended claims.

I claim:

1. An electrical fuse having a fuse element, housing and electrically conductive terminals, said fuse element comprising:

an elongated element body of electrically conductive material, said fuse element body including first and second ends, a plurality of substantially parallel weak spots, a plurality of heavy portions separated by said weak spots, each of said weak spots lying between and separating two of said heavy portions, said heavy portions forming a plurality of peaks so as to define a saw-tooth configuration.

2. The electric fuse as claimed in claim 1, wherein said weak spots are defined by a plurality of first notches formed in a first side of said elongated fuse element body, each said first notch of each including a first side edge extending generally transverse to said axis and a second edge meeting said first edge and extending therefrom at an acute angle with said first edge, and a plurality of second notches each including a first edge generally parallel with said first edge of said first notches and a second edge meeting said first edge of each of said second notches and lying generally parallel with said second edges of said first notches, each said weak spot defined between the point of meeting of said first and second edges of said first notches and the point of meeting of said first and second edges of said second notches.

3. The electric fuse as set forth in claim 1, wherein said weak spots are electrically in series.

4. The electric fuse as set forth in claim 1, wherein said peaks are adapted to assist in centering said fuse element within said housing.

5. The electric fuse as set forth in claim 1, wherein said peaks are arranged to locate said weak spots near the center of said housing and to transfer minimum heat to said housing.

6. An electric fuse, comprising:

a tube of insulating material, said tube including first and second ends, a first electric conducting end cap on said first end, a second electric conducting end cap on said second end, and a fuse element mounted in said tube and electrically connected in series with said end caps, said fuse element including an elongated body with a plurality of adjacent heavy portions and a plurality of weak spots disposed between said adjacent heavy portions, said heavy portions forming a plurality of peaks in a substantially saw-tooth configuration, wherein said weak spots being substantially parallel to one another and extending generally transverse relative to said elongated body, and said heavy portions extending at an acute angle relative to said elongated body.

7. The electric fuse as claimed in claim 6, wherein said body includes first and second sides, said first side including a plurality of first notches, each of said first notches including first and second edges meeting at a first apex, said first edge extending generally transverse to the length of said elongated body, said second edge extending at an acute angle to said first edge, said second side including a plurality of second notches, each of said second notches meeting at a second apex, each of said second notches including a first edge generally parallel with said first edge of an adjacent first notch, each of said second notches including a second edge generally parallel with and extending in the opposite direction from said second edge of an adjacent first notch, said weak spots defined between said first and second apexes.

8. The electric fuse as claimed in claim 6, wherein the width of said weak spots is the closest distance between said first edges of said first and second notches.

9. The electric fuse as claimed in claim 6, wherein said weak spots are electrically in series.

10. The electric fuse as claimed in claim 7, wherein said peaks are adapted to assist in centering said fuse element within said tube.

11. The electric fuse as claimed in claim 6, wherein said peaks are arranged to locate said weak spots near the circular center line of said tube and to transfer minimum heat to said tube.

12. An electric fuse for placement in electrical series with a circuit to be protectd such that all current flowing into the protected circuit must flow through said electric fuse, said fuse including a fuse element in electrical series with said protected circuit, a tube of insulating material with first and second ends and electrically conductive end caps on each of said first and second ends, said fuse element comprising:

an elongated body positioned in said tube in electrial series with said end caps, said body defined by a plurality of weak spots and heavy portions, said heavy portions forming a plurality of peaks so as to define a saw-tooth configuration, each said weak spot being situated between adjacent heavy portions, said weak spots being generally parallel and each of said weak spots being substantially transverse to an axis extending between said first and second ends, each of said heavy portions having top and bottom edges, said weak spots being arranged such that one end of said top of each said heavy portion is connected through said weak spots to one end of said bottom of said adjacent heavy portion such that the current through each of said weak spots flows transverse to and in the same direction relative to said axis.

13. The fuse as set forth in claim 12, wherein each of said heavy portions lies parallel to and offset from adjacent heavy portions.

14. The fuse as set forth in claim 12, wherein each said heavy portion extends at an acute angle to said weak spots.

15. The fuse as set forth in claim 12, wherein said peaks are adapted to assist in centering said fuse element within said tube.

16. The fuse as set forth in claim 12, wherein said peaks are arranged to locate said weak spots near the circular center line of said tube and to transfer minimum heat to said tube from said weak spots.

* * * * *